US005940517A

United States Patent [19]

Shinada et al.

[11] Patent Number: 5,940,517

[45] Date of Patent: Aug. 17, 1999

[54] SOUND-VOLUME DISPLAY UNIT FOR USE IN AUDIO SYSTEM

[75] Inventors: Akira Shinada; Takaharu Fujii, both of Kanagawa, Japan

[73] Assignee: Sony Corporation, Tokyo, Japan

[21] Appl. No.: 08/957,893

[22] Filed: Oct. 27, 1997

[30] Foreign Application Priority Data

Nov. 1, 1996 [JP] Japan ..... 8-307064

[51] Int. Cl.[6] ..... H04R 29/00

[52] U.S. Cl. ..... 381/58; 381/86; 345/35

[58] Field of Search ..... 381/58, 56, 86, 381/104, 109, 102; 345/352, 353, 354, 35

[56] References Cited

U.S. PATENT DOCUMENTS 5,537,614 7/1996 Hagimori et al. ..... 381/58

*Primary Examiner*—Ping Lee
*Attorney, Agent, or Firm*—Jay H. Maioli

[57] ABSTRACT

A sound-volume display unit for use in an audio system has a key for controlling the sound volume, a display device, and a display control device. When the key is not operated, the display control device displays information other than the sound volume on the display device. When the key is operated and when the level of the sound volume corresponding to the key operation is not minimum, the display control device displays the corresponding level of the sound volume on the display device for a predetermined duration. After a lapse of the predetermined duration, the display control device causes the display device to return to the display state used before the level of the sound volume was displayed. On the other hand, when the key is operated and when the level of the sound volume corresponding to the key operation is minimum, the display control device displays the corresponding level of the sound volume on the display device and also maintains the display state even after a lapse of the predetermined duration.

3 Claims, 5 Drawing Sheets

SOUND-VOLUME DISPLAY UNIT FOR USE IN AUDIO SYSTEM

BACKGROUND OF THE INVENTION

1. Field of the Invention

The present invention relates to a sound-volume display unit for use in an audio system.

2. Description of the Related Art

In a typical audio system loaded in, for example, a vehicle, i.e., in a car audio system, the function and the size of the display unit are restricted.

An example of the display unit or the operation unit of a car audio system having a CD player is shown in FIG. 4. More specifically, in FIG. 4, reference numeral 31 indicates a display device, which is a color liquid crystal display (LCD), formed of 240 (column)×64 (row) display dots, whereby characters, numbers, signs, etc. can be displayed. As illustrated in FIG. 4, the title of the track which is currently reproduced from the CD is shown in the upper part of the LCD 31 in normal conditions; and the disc number, the track number, and the play-back time are indicated on the lower part of the LCD 31 in the direction from left to right in the given order.

Reference numeral 32 designates operation keys. In normal conditions, keys 32M and 32P function as sound-volume control keys. When a key 32S is pressed, the functions of the keys 32M and 32P are changed to serve as sound-quality control keys.

With this arrangement, when the key 32M is pressed one time, the sound volume of the speaker is decreased by one step, and the LCD 31 is also changed from the state shown in A to that of B of FIG. 5. More specifically, the title of the track indicated on the upper part of the LCD 31 is changed to "VOL" representing the sound volume, and the number of bars corresponding to the volume of the sound which is currently reproduced from the CD is reduced by one step. Thereafter, every time the key 32M is pressed, the sound volume from the speaker is turned down by one step, and the number of bars indicating the sound volume displayed on the upper part of the LCD 31 is also decreased by one step, as illustrated in C and D of FIG. 5.

When the sound volume reaches zero by pressing the key 32M for several times, the sound volume no longer changes upon further presses of the key 32M. At this time, the LCD 31 indicates that the sound volume is zero, i.e., "VOL MIN", as shown in E of FIG. 5.

If, however, none of the keys 32 has been pressed for, for example, five seconds, after the LCD 31 was changed to one of the states illustrated in B through E of FIG. 5, the LCD 31 returns to the normal state shown in A of FIG. 5, i.e., the original state used before the volume control was performed.

In contrast, when the key 32P is pressed one time, the sound volume is raised by one step, and the number of bars representing the sound volume is increased by one step, as illustrated in E through B of FIG. 5, in a manner similar to the operation of the key 32M and in the reverse order. If the key has not been operated for five seconds after the sound volume was changed, the LCD 31 returns to the original normal state illustrated in A of FIG. 5.

In this manner, the LCD 31 normally displays information concerning the sound source of the car audio system having a CD player. When, however, the key 32P or 32M is pressed, the source information indicated on the LCD 31 is changed to the sound volume, and thereafter, if no key input has been made for, for example, five seconds, the LCD 31 automatically returns to the original state designating source information.

It is therefore possible to obtain the required information, such as information concerning the sound source or the sound volume without performing a specific key operation even in a small display area of the LCD 31.

In the above-described display method, however, if sound is not output from the speaker, the reason is unknown to the user because the sound volume is not normally indicated on the LCD 31. Namely, it is impossible to determine the reason why the sound does not come out from the speaker, i.e., whether the sound volume has been reduced to zero by operating the key or the audio system has encountered trouble, for example, the CD player (CD changer) installed in the trunk of the vehicle or the wiring of the player has failed.

SUMMARY OF THE INVENTION

Accordingly, it is an object of the present invention to solve the above-described problem.

In order to achieve the above object, there is provided a sound-volume display unit having a key for controlling the sound volume and a display device. When the key is not operated, information other than the sound volume is displayed on the display device. When the key is operated and if the level of the sound volume corresponding to the key operation exceeds a predetermined value, the level of the sound volume corresponding to the key operation is displayed on the display device for a predetermined duration. After a lapse of the predetermined duration, the display device is caused to return to the display state used before the level of the sound volume was displayed. On the other hand, when the key is operated and if the level of the sound volume corresponding to the key operation is equal to or less than the predetermined value, the corresponding level of the sound volume is displayed on the display device, and the display state is maintained even after a lapse of the predetermined duration.

Consequently, when the level of the sound volume is reduced to minimum through the operation of the user, this information continues to be displayed on the display device.

According to the present invention, when the level of the sound volume is controlled, the corresponding information is displayed on the display device. If the sound volume has not been reduced to minimum, the display device returns to the original state used before the sound volume was adjusted after a lapse of a predetermined duration. If, on the other hand, the sound volume has been reduced to minimum, the corresponding information continues to be displayed on the display device. As a consequence, it is possible to judge the reason why sound does not emit from the speakers (headphones), i.e. whether the sound volume has been reduced to zero through a key operation or the audio system has encountered trouble. The configuration for achieving the foregoing technique can be readily implemented without increasing the cost merely by modifying part of a known routine for displaying the sound volume.

DESCRIPTION OF THE PREFERRED EMBODIMENT

Figure 1:
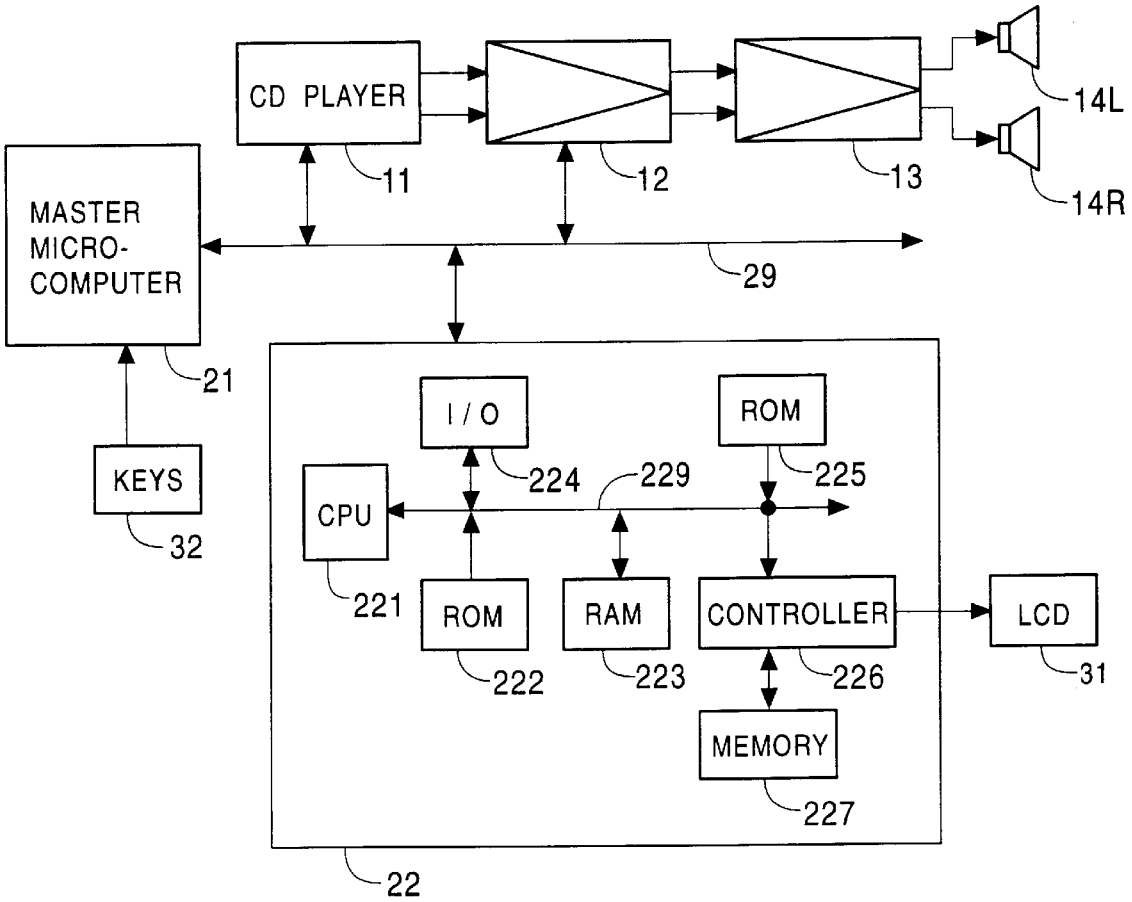
FIG. 1 is a block diagram illustrating an embodiment of the present invention.

The present invention will now be described in detail with reference to the drawings. Referring to FIG. 1, an audio signal output from a CD player 11, which serves as an audio signal source, is supplied to a preamplifier 12 in which the sound volume and the sound quality of the signal are processed. The processed signal is fed to speakers 14L and 14R on the left and right channels via a main amplifier 13.

The CD player 11 and the preamplifier 12 each have a system control microcomputer, though they are not shown. When data is supplied to the microcomputer of the CD player 11 from an external source, the CD player 11 enters an operating mode in accordance with the input data, for example, the playback of the CD. Similarly, when data is fed to the microcomputer of the preamplifier 12 from an external source, the preamplifier 12 goes into an operating mode in accordance with the input data, for example, decreasing the sound volume by one step.

Figure 4:
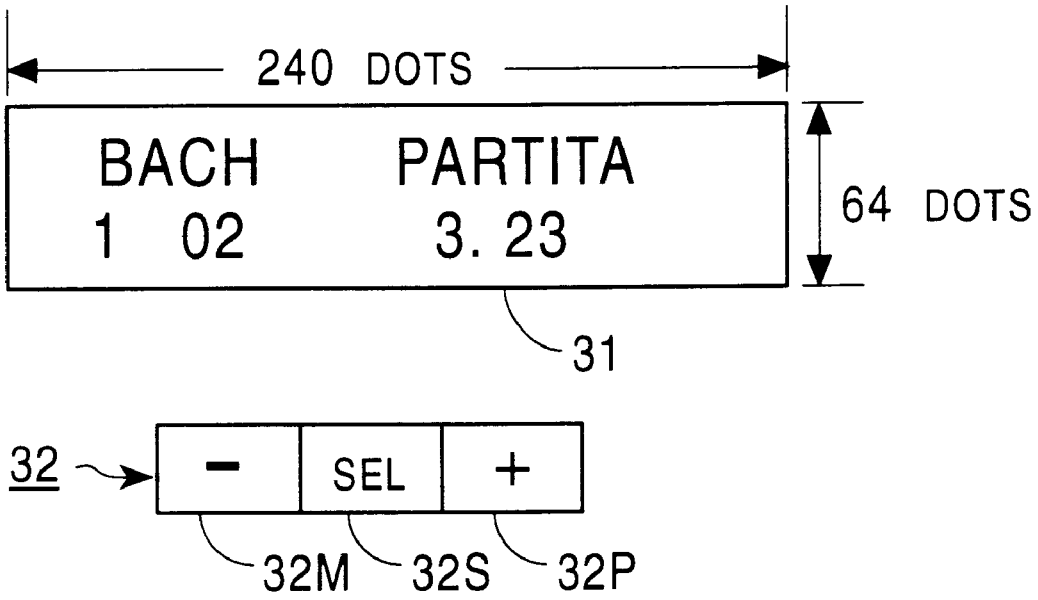
FIG. 4 (PRIOR ART)
FIG. 4 illustrates an example of the LCD used in the present invention.
Figure 5:
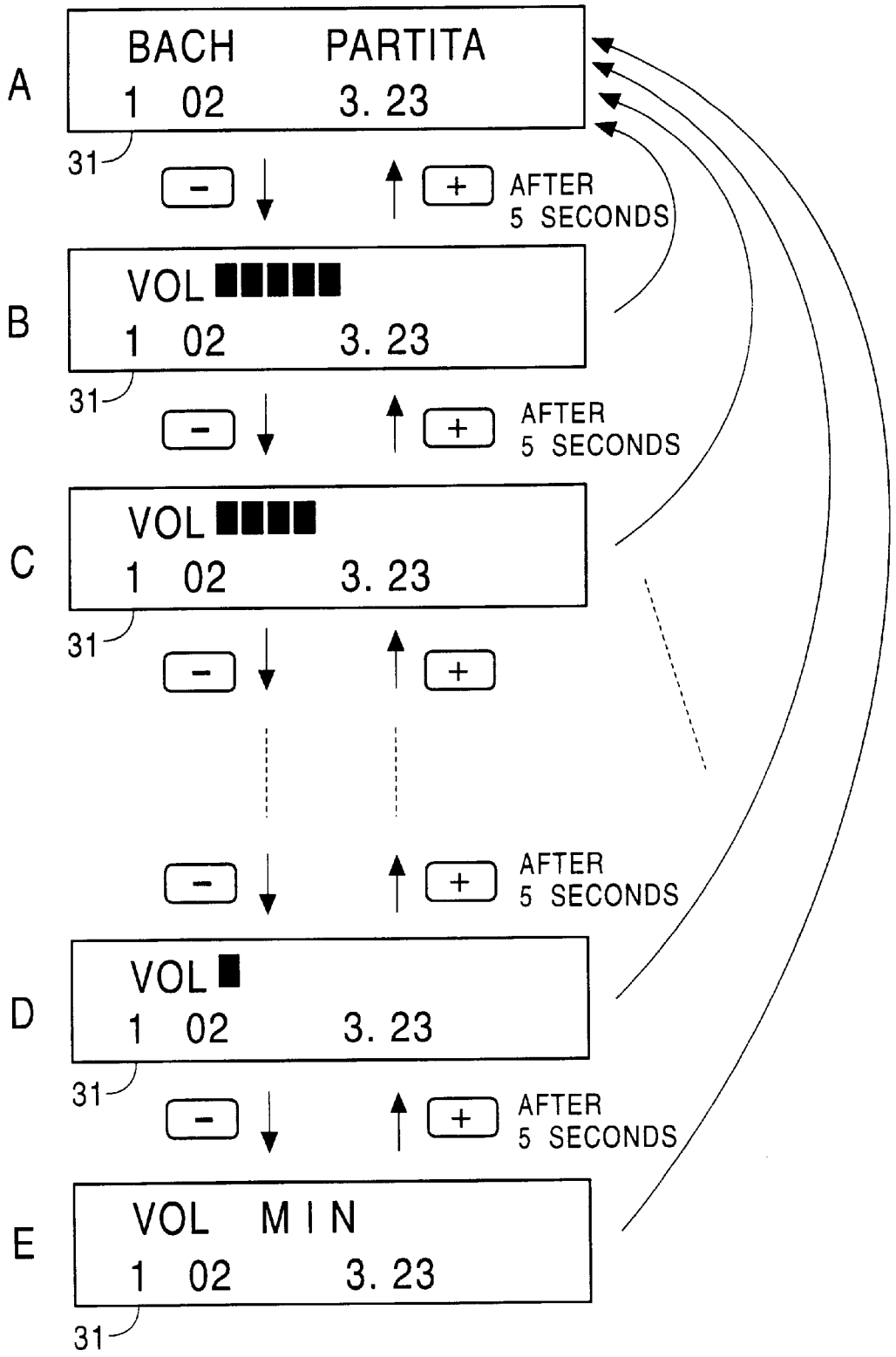
FIG. 5 (PRIOR ART)
FIG. 5 illustrates the display states of the LCD according to a known routine for displaying the sound volume.

Further, a master control microcomputer 21 is provided, which is connected to the microcomputers of the CD player 11 and the preamplifier 12 via a bus 29. Operation keys 32, such as those shown in FIG. 4, are connected to the microcomputer 21, and display control means, i.e., a display microcomputer 22, is also connected to the microcomputer 21 via the bus 29.

Figure 2:
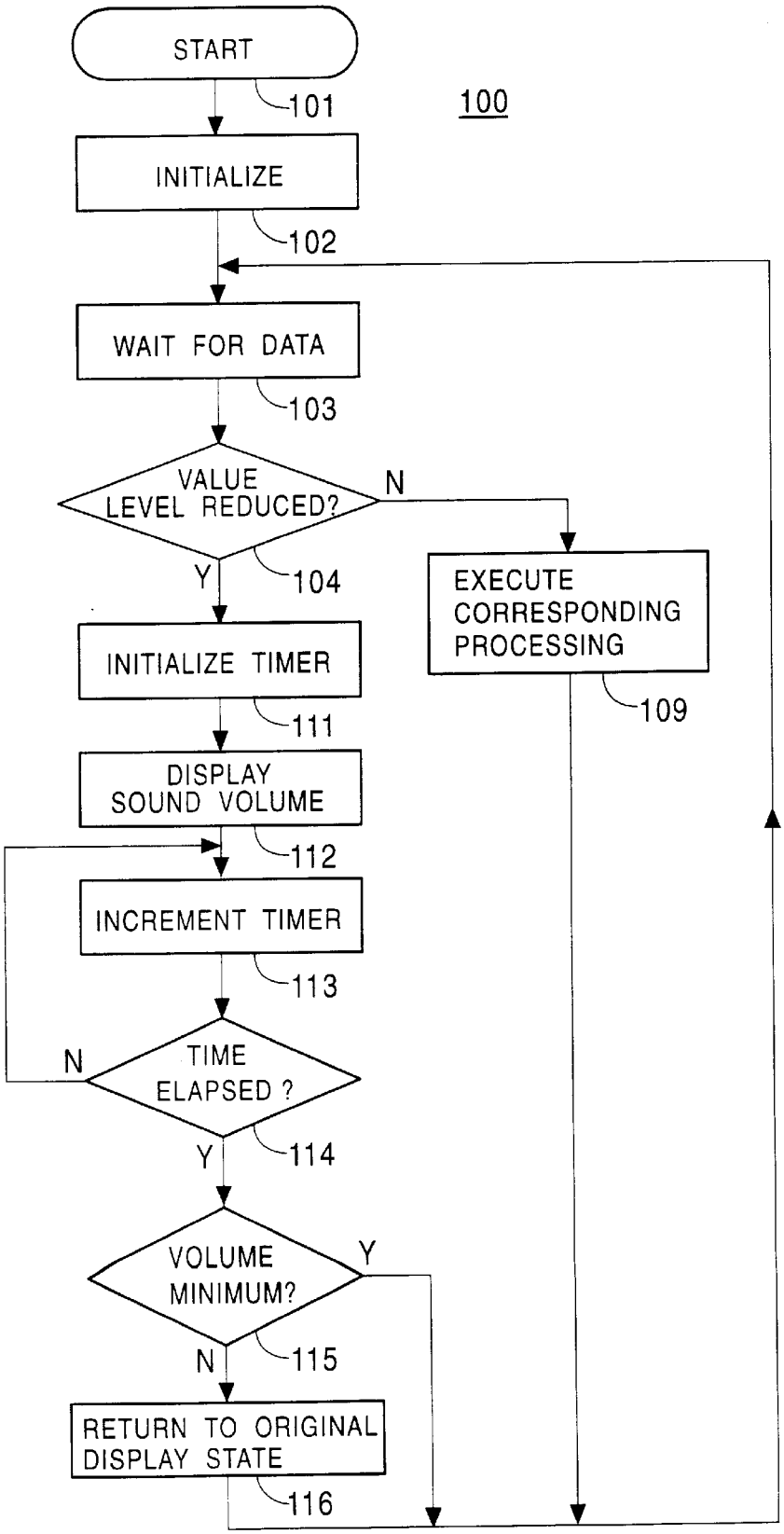
FIG. 2 is a flow chart illustrating an embodiment of the present invention.

The display microcomputer 22 contains a CPU 221 for running a program, a ROM 222 for storing the program, and a RAM 223 for a work area. The ROM 222 and the RAM 223 are connected to the CPU 221 via a system bus 229. Stored in the ROM 222 is, for example, a display routine 100 shown in FIG. 2. This routine 100 will be described later, and only the part of the routine 100 related to the display operation is shown in FIG. 2 for the purpose of simplicity.

Moreover, connected to the bus 229 are an input/output port 224, a font ROM (character generator) 225 having font data, and a display controller 226. A display memory 227 and a display device, for example, a color LCD 31, are connected to the controller 226. In this embodiment, the LCD 31, which displays characters, numbers, signs, etc. by a combination of dots, is able to express, for example, the display state shown in FIG. 4. The memory 227 stores data as a bit map image, whereas the LCD 31 displays data as dots, and the memory 227 has a capacity of storing one frame of the LCD 31. The character data stored in the RAM 223 is read out to the CPU 221 and is converted into display data by using the font data stored in the ROM 225. The display data is then written into the memory 227 via the controller 226.

The display data is also repeatedly read from the memory 227 by the controller 226 and is further converted into a display signal, which is then supplied to the LCD 31. Accordingly, the characters, numbers, signs, etc. corresponding to the data read from the RAM 223 by the CPU 221 are displayed on the LCD 31.

With this arrangement, if, for example, the key 32M, is pressed from the keys 32 when the sound source information is displayed on the LCD 31, this input operation is detected by the master microcomputer 21 to create data representing an instruction to decrease the sound volume by one step. This data is then fed to the microcomputer of the preamplifier 12.

Thus, the level of the audio signal is reduced by one step in the preamplifier 12, and the sound volume from the speakers 14L and 14R is accordingly turned down by one step. Moreover, the microcomputer of the preamplifier 12 generates data representing that the level of the sound volume has been reduced and also indicating the level of the reduced volume. This data is sent to the display microcomputer 22 and is written into a predetermined address of the RAM 223.

Namely, any operation of the keys 32 is decoded by the master microcomputer 21, and the data representing the key operation is created so as to control the device related to the input operation. Further, if it is necessary that the results of the control operation be displayed, the microcomputer of the controlled device produces the corresponding data. This data is then sent to the display microcomputer 22 and is stored in the RAM 223.

The processing executed by the display microcomputer 22 based on the display routine 100 will now be explained.

When power is supplied, the CPU 221 starts processing from step 101 of the display routine 100, as shown in FIG. 2. In step 102, the individual elements are then initialized.

Thereafter, in step 103 the CPU 221 starts to wait for data input from the master microcomputer 21. When data is sent from the microcomputer 21, the processing proceeds to step 104 in which it is determined whether the data received in step 103 indicates a reduction in the volume level (whether the key 32M has been pressed).

If the answer of step 104 is no, the processing proceeds to step 109 in which the processing corresponding to the data is executed. Subsequently, processing returns to step 103 in which the CPU 221 continues to wait for data input. Consequently, the data representing the playback state of the CD player 11 is normally supplied to the display microcomputer 22 from the microcomputer of the CD player 11, and is accordingly displayed on the LCD 31, as illustrated A in FIG. 3 , for example.

On the other hand, if it is found in step 104 that the key 32M has been pressed, i.e., that the data represents a reduction in the volume level, the processing proceeds to step 111 in which a software timer is initialized. Subsequently, in step 112 display data is produced according to the data stored in the RAM 223 representing the decreased level, and the generated display data is then supplied to the controller 226. Accordingly, the display state of the LCD 31 is switched, for example, from A to B of FIG. 3, and the number of bars indicating the sound volume is decreased by one step. The changed display state, for example, the one illustrated in B of FIG. 3, continues until new display data is fed to the controller 226 or a predetermined duration has elapsed, which will be explained in detail below.

The processing further proceeds to step 113 in which the timer initialized in step 111 is incremented by a predetermined number. In step 114, it is then checked whether the incremented number of the timer is greater than a prescribed value corresponding to, for example, five seconds. If the timer number does not exceed five seconds, the processing returns to step 113. Namely, steps 113 and 114 have been repeated at least for five seconds since the reduced sound volume started to be displayed on the LCD 31 in step 112.

If it is found in step 114 the timer number exceeds five seconds, the processing proceeds to step 115 in which it is checked whether the level of the current audio signal is equal to a predetermined value, for example, zero (minimum), by referring to the data stored in the RAM 223. If the answer of step 115 is no, i.e., if the level of the current audio signal is not zero, for example, as shown in B of FIG. 3, the processing proceeds to step 116. In step 116, the display data used before the display state of the LCD 31 was changed in step 112 is supplied to the controller 226, which causes the LCD 31 to return to the original state. Thereafter, the processing returns to step 103.

Figure 3:
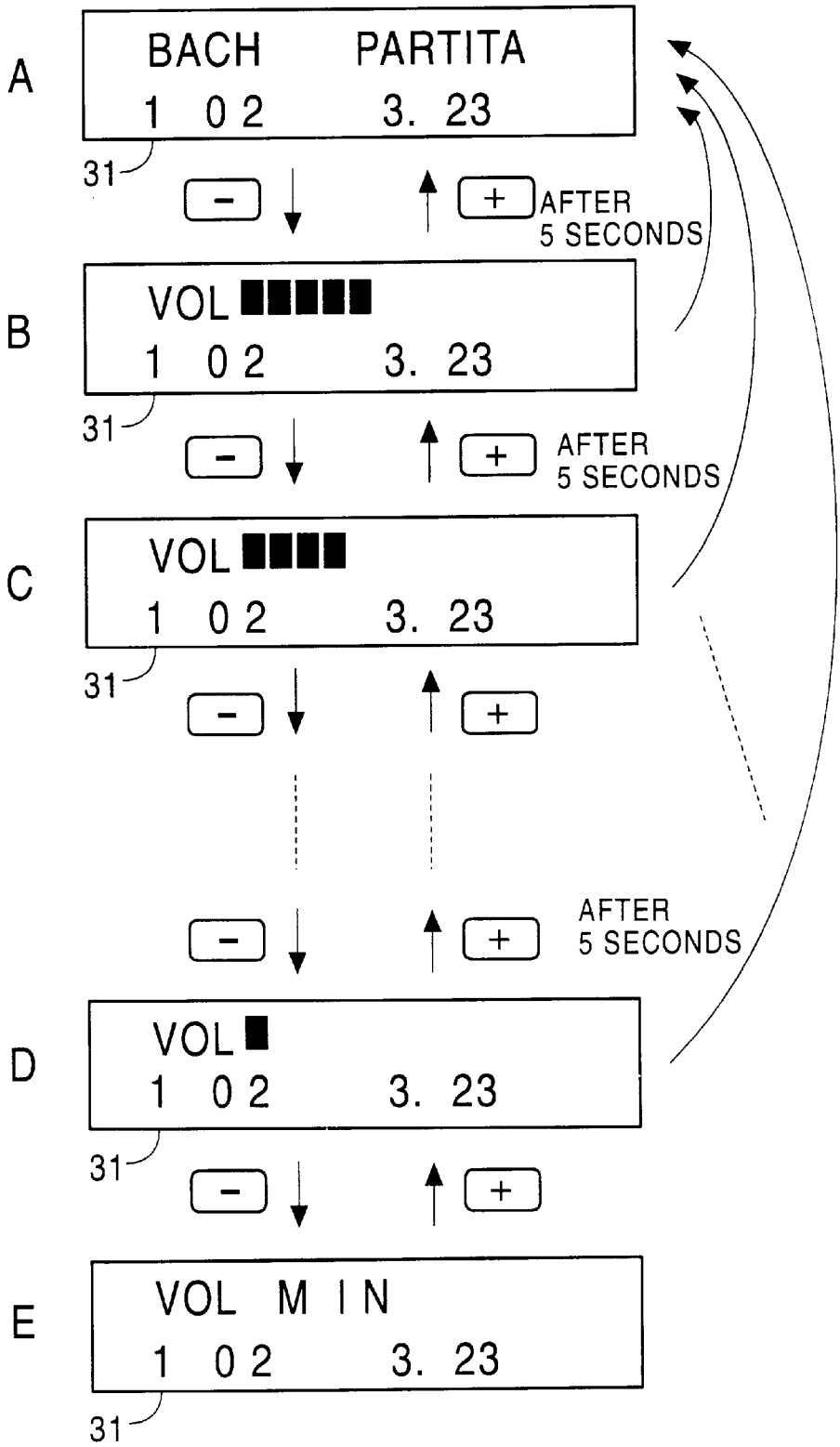
FIG. 3 illustrates the display states of the LCD used in the present invention.

Accordingly, when the processing in step 116 is executed, the LCD 31 returns to the state, such as the one illustrated in A of FIG. 3, i.e., the original state used before the key 32M was pressed. In the above manner, every time the key 32M is pressed, the sound volume from the speakers 14L and 14R is turned down by one step, and the number of bars indicated on the LCD 31 is decreased by one step, as shown in B through D of FIG. 3.

If the sound volume has been reduced to zero (minimum), the LCD 31 is changed into the state shown in E of FIG. 3 in step 112, and processing steps 113 and 114 are then executed. After a lapse of five seconds, the processing proceeds to step 115 in which it is found that the sound volume is zero. Thus, the processing skips step 116 and returns to step 103. As a result, the display state of the LCD 31 shown in E of FIG. 3 maintains and waits for subsequent data input, i.e., subsequent key input.

If the key 32P is pressed, the sound volume is increased from zero by one step in step 109, and the display state of the LCD 31 is changed from E to D of FIG. 3.

According to the foregoing sound-volume display unit, when the sound volume is controlled, the corresponding information is displayed on the LCD 31. If the sound volume is not zero, the LCD 31 returns to the original state used before the volume was adjusted, after a predetermined duration. On the other hand, if the sound volume is reduced to zero, the LCD 31 continues to indicate the corresponding information.

Hence, if sound does not come out from the speakers 14L and 14R, it is possible to determine the reason, i.e., whether the sound volume has been reduced to zero by operating the key or the audio system has encountered trouble. The configuration for achieving the foregoing technique can be easily implemented without increasing the cost merely by modifying part of a known routine used for displaying the sound volume, as indicated by the routine 100 shown in FIG. 2.

In the foregoing embodiment, the LCD 31 indicating that the sound volume is zero, such as the one shown in E of FIG. 3, may be expressed in a color different from the color indicating the other sound volumes. This makes it possible to show more clearly that the sound volume has been adjusted to zero. Additionally, the present invention may be applicable to audio systems using headphones (earphones), such as, headphone stereos, radio receivers and cassette players.

What is claimed is:

1. A sound-volume display unit for use in an audio system, comprising:

a key for controlling a level of a sound volume;

a display device; and display control means for controlling said display device to display information other than said level of said sound volume when said key is not operated, wherein when said key is operated and said level of said sound volume corresponding to said key operation exceeds a predetermined value, said display control means controls said display device to display said level of said sound volume for a predetermined time, and after said predetermined time has elapsed controls said display device to return to a display state before said level of said sound volume was displayed, and wherein when said key is operated and said level of said sound volume corresponding to said key operation is equal to said predetermined value said display control means controls said display device to display said predetermined value on said display device and maintains said display state of said display device after said predetermined time has elapsed.

2. The sound-volume display unit according to claim 1, wherein when said key is operated and when said level of said sound volume corresponding to said key operation is different than a minimum, said display control means controls said display device to display said level of said sound volume for said predetermined time and after said predetermined time has elapsed controls said display device to return to said display state before said level of said sound volume was displayed, and wherein when said key is operated and said level of said sound volume corresponding to said key operation is minimum, said display control means controls said display device to display information indicating that said level of said sound volume is minimum and also maintains said display state of said display device after said predetermined time has elapsed.

3. The sound-volume display unit according to claim 1, wherein said display control means cancels said display state of said display device in response to a key operation instructing an increase in said level of said sound volume while said display state is maintained after said predetermined time has elapsed.

* * * * *